US006203112B1

(12) United States Patent
Cook et al.

(10) Patent No.: US 6,203,112 B1
(45) Date of Patent: Mar. 20, 2001

(54) ATTACHABLE ROAD CUTTING APPARATUS

(75) Inventors: Eugene Cook, Greenlawn; William Isenberg, East Northport, both of NY (US)

(73) Assignee: American Standards Construction Corp., Westbury, NY (US)

( * ) Notice: Subject to any disclaimer, the term of this patent is extended or adjusted under 35 U.S.C. 154(b) by 0 days.

(21) Appl. No.: 09/304,442

(22) Filed: May 3, 1999

(51) Int. Cl.[7] ..... E01C 23/09

(52) U.S. Cl. ..... 299/39.3; 299/39.1; 299/36.1; 125/13.01; 404/93

(58) Field of Search ..... 299/36.1, 39.1, 299/39.3, 39.4, 39.6; 404/90, 91, 93, 94, 85, 86, 84.1; 172/76, 78; 451/451, 454, 455; 125/13.01, 13.03; 474/26

(56) References Cited

U.S. PATENT DOCUMENTS

| | | | | |
|---|---|---|---|---|
| 1,792,242 | * | 2/1931 | Reeves | 474/26 |
| 2,787,943 | * | 4/1957 | Browning | 172/72 |
| 3,945,681 | | 3/1976 | White . | |
| 4,060,942 | * | 12/1977 | White et al. | 451/451 |
| 4,299,424 | | 11/1981 | LeBegue et al. . | |
| 4,358,123 | * | 11/1982 | Richards | 280/47.131 |
| 4,375,212 | | 3/1983 | Santchi . | |
| 4,748,966 | | 6/1988 | Kennedy . | |
| 4,762,371 | * | 8/1988 | Lupton | 404/91 X |
| 4,840,431 | | 6/1989 | Jedick . | |
| 4,878,713 | * | 11/1989 | Zanetis | 299/39.5 |
| 4,900,094 | * | 2/1990 | Sergeant | 299/39.6 |
| 4,953,523 | | 9/1990 | Swan . | |
| 4,998,775 | * | 3/1991 | Hollifield | 299/39.3 X |
| 5,011,229 | | 4/1991 | O'Neill et al. . | |
| 5,040,850 | | 8/1991 | Komotzki . | |
| 5,236,278 | * | 8/1993 | Dickson | 404/90 |
| 5,388,893 | * | 2/1995 | Maxwell et al. | 299/39.6 |
| 5,484,228 | * | 1/1996 | Thomas et al. | 404/90 |
| 5,529,384 | | 6/1996 | Ojanen et al. . | |
| 5,537,729 | | 7/1996 | Kolobow . | |
| 5,676,126 | | 10/1997 | Rupprecht et al. . | |
| 5,676,490 | * | 10/1997 | Nelson | 299/39.4 X |
| 5,713,418 | * | 2/1998 | Warren et al. | 404/117 X |
| 5,720,528 | | 2/1998 | Ritchey . | |
| 5,722,789 | | 3/1998 | Murray et al. . | |
| 5,724,956 | | 3/1998 | Ketterhagen . | |
| 5,857,453 | | 1/1999 | Caven et al. . | |
| 5,875,573 | * | 3/1999 | Hayden | 172/49.5 |
| 6,030,169 | * | 2/2000 | Rossow et al. | 180/273 X |
| 6,035,757 | * | 3/2000 | Caluori et al. | 83/520 |

OTHER PUBLICATIONS

"Downsizing Transformer Pads In California" re: G&F Concrete Cuttings, Inc., Santa Ana, CA, Concrete Openings, pp. 28–29 (advertisement), undated.

"Asphalt Zipper, Asphalt Mill/Trencher", pp. 1–6, (advertisement) 1998 by Asphalt Zipper Company.

* cited by examiner

*Primary Examiner*—David Bagnell
*Assistant Examiner*—Sunil Singh
(74) *Attorney, Agent, or Firm*—John F. Vodopia

(57) ABSTRACT

A road cutting apparatus is detachable and connectable to a self-propelled front end loading machine. The cutting apparatus includes a rigid frame structure having a connecting section for attaching the frame structure to the front end loading machine and a planar mounting section. An engine including a power take off (PTO) is mounted to a top surface of the mounting section for driving the circular cutting apparatus, and a belt drive is attached to the PTO. The belt drive includes a driving pulley and a following pulley, and a belt disposed between the driving pulley and following pulley provides for transfer of torque therebetween. A driven shaft with a first end and a second end is mounted to the mounting section and attached to the following pulley at its first end, and a retainer blade is connected to the second end for coupling to a circular cutting blade. A cutting assembly is mounted on the mounting section which includes the circular cutting blade and a cooling system for cooling the cutting blade. The circular cutting blade rotates counterclockwise relative a forward cutting direction of the front end loader when the PTO is engaged and powered by the engine.

20 Claims, 3 Drawing Sheets

ATTACHABLE ROAD CUTTING APPARATUS

BACKGROUND OF THE INVENTION

The present invention relates to road cutting apparatus generally, and more specifically relates to a road cutting apparatus which is light weight and attachable to various self-propelled construction vehicles for high-speed accurate cuts in asphalt, concrete, reinforced concrete and like road surfaces.

Various road surface cutting apparatus are known for cutting or slotting asphalt, concrete and like road surfaces. For example, U.S. Pat. No. 4,840,431 to Jedick discloses a portable rotary saw for cutting grooves into surfaces such as concrete and asphalt. The '431 patent attempts to solve problems with portable rotary power saws where users need to adjust cutting depth as well as maintain their grip on the apparatus. However, such road cutting apparatus do not efficiently conduct substantial cuts quickly. Portable hand held cutting apparatus just do not have the size to support a power source or engine which can carry out large cutting tasks.

Various self-propelled cutting apparatus are known. For example, U.S. Pat. No. 5,857,453 to Caven et al. discloses a precision slot cutting machine for asphalt and concrete which includes a self-propelled unit with an operators station and a blade platform attached by pivot arms to allow the blade platform to freely pivot about an axis of travel to the unit. The purpose is to allow that variations which occur in the pavement surface in directions both parallel and across the travel path of the machine are compensated for.

U.S. Pat. No. 5,724,956 to Ketterhagen discloses a riding saw for cutting concrete, asphalt, rock, etc. The saw includes a seat for supporting the rider and a mechanical steering assembly for manipulating a position of a rear drive wheel powered by a hydraulic engine. The '956 device requires that the hydraulic engine power both the saw and the drive mechanism.

U.S. Pat. No. 5,676,126 discloses a self-propelled masonry slitting apparatus comprised of a housing with two handles and a drive unit for a slitting tool including at least one cutting disk. U.S. Pat. No. 4,953,523 to Swan discloses a self-propelled asphalt/concrete abrader with a quick release mechanism for disengaging the masonry saw it utilizes for cutting.

U.S. Pat. No. 4,748,966 to Kennedy discloses a self-propelled concrete cutting saw in which the saw and the self-propelled platform associated with the saw are both driven by hydraulic engines. The saw is able to vary its forward moving speed depending on the density of the concrete it is cutting. And U.S. Pat. No. 4,375,212 to Santschi discloses a self-propelled sawing machine control apparatus for use on self-propelled walk-behind or ride-on grooving and/or grinding machines.

However, self-propelled cutting or grooving machines are not portable, and therefore not compatible for use in a variety of cutting environments and jobs. Another problem with conventional road cutting apparatus is that the depth of the cut is sometimes inconsistent, particularly self-propelled. There is a tendency for the cutting blade to "climb out" of the cut.

OBJECTS AND SUMMARY OF THE INVENTION

It is therefore an object of the present invention provide a cutting apparatus for cutting asphalt, concrete and like road surfaces which overcomes the shortcomings of the portable and self-propelled cutting apparatus of the prior art.

It is another object of the present invention to provide a cutting apparatus for cutting asphalt, concrete and like road surfaces which is easily attachable/detachable to a front end loader, skid steer, or similar self-propelled construction vehicle.

It is another object of the present invention to provide a cutting apparatus for cutting asphalt, concrete and like road surfaces wherein at least one cutting blade is mounted on the apparatus and driven to rotate and cut in a counterclockwise direction relative the forward cutting direction.

It is another object of the present invention provide a cutting apparatus for cutting asphalt, concrete and like road surfaces comprising a diesel engine for powering a circular cutting apparatus.

It is another object of the present invention to provide a cutting apparatus for cutting asphalt, concrete and like road surfaces which is mounted on a frame structure in such a way that it is easily adjusted to compensate for normal wear and tear of a drive mechanism for transfer of an engine's torque to a cutting blade.

In one embodiment, the cutting apparatus of the invention includes a diesel or gasoline engine mounted on a frame structure which is detachable and connectable to a front end loading vehicle, e.g., skid steer. The engine is coupled to a cutting assembly through a PTO and a pulley drive mechanism (also mounted on the frame structure). A first cutting blade is included in the cutting assembly such that the rotational force provided by the pulley drive mechanism causes radial rotation of the cutting blade in a counterclockwise direction relative the forward direction of front-end loading machine.

The frame structure includes a mounting section and a section for attaching the frame structure to the loading machine. The attaching section preferably includes a machine plate arranged for attachment to the connecting blades of the front end loading machine. The apparatus also includes a guide frame or skid plate, with a spring bar mechanism, the skid plate extending down from the structure for contacting the surface to be cut in order to define and control a depth of the cut. A shield or cowling is also preferably included around the cutting blade, and one or more spray nozzles mounted on the inside portion of the cowling for providing a fluid flow directly on the blade when the blade is engaged and cutting.

The preferred diesel engine is a 41 HP diesel engine. The preferred cutting blade is a 36 inch diameter diamond blade, ¼", but most conventional blades can be used, for example, 18", 20" and 22" diameter with a ¼" or ⅛" widths.

BRIEF DESCRIPTION OF THE DRAWING FIGURES

DETAILED DESCRIPTION OF THE INVENTION

Figure 1:
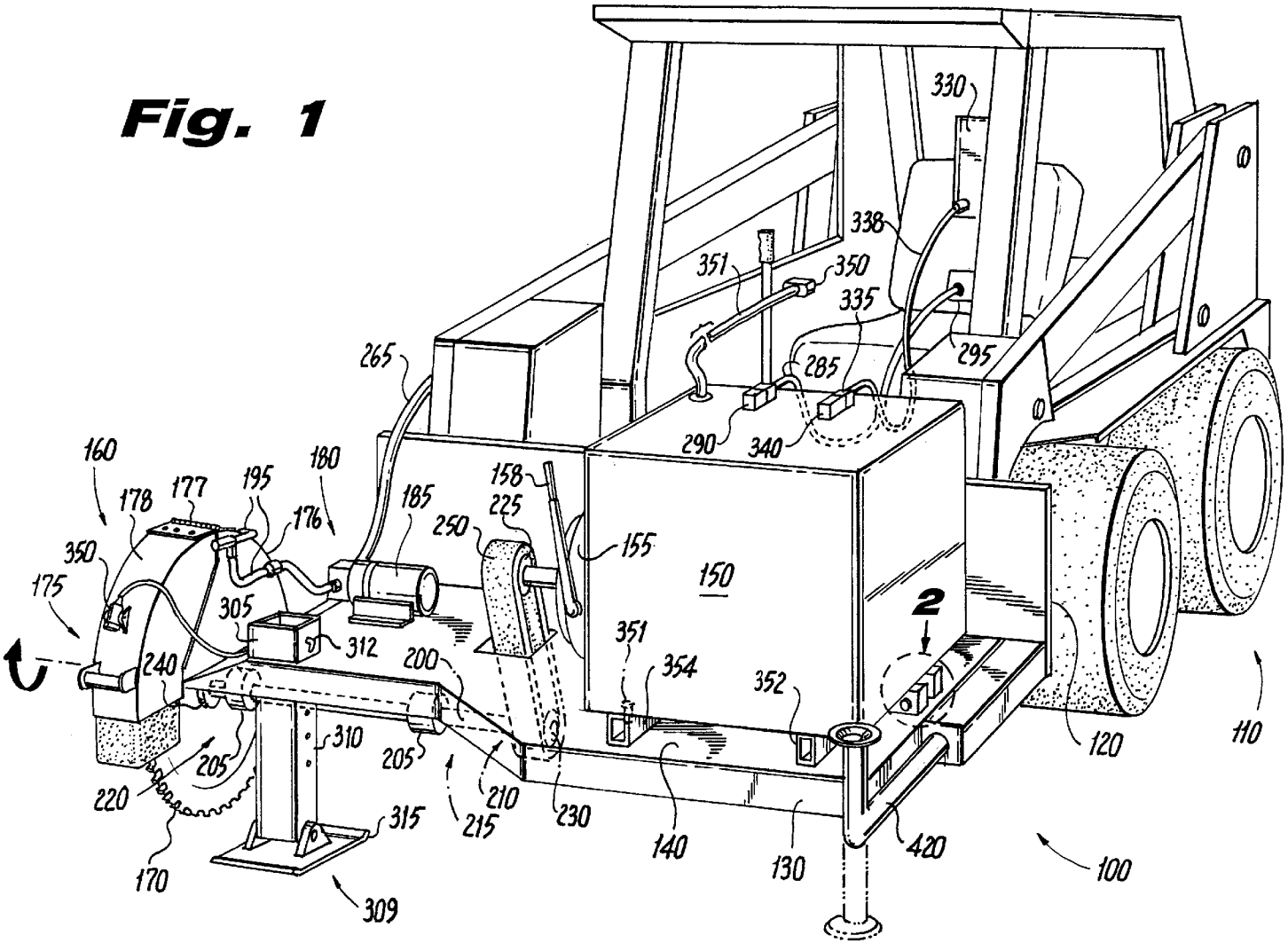
FIG. 1 is a description diagram of a frontal view of a first embodiment of a cutting apparatus of this invention.

One or more specific embodiments of the invention now will be described with reference to the drawing figures. The reader should note, however, that the specific embodiments presented herein are for exemplary purposes only, and are not meant to limit the scope of the invention, which should be limited only by the claims appended to this specification.

A first embodiment of a road cutting apparatus 100 of this invention is shown in FIG. 1 attached to a skid steer 110. The road cutting apparatus 100 is removably attachable to the skid steer at a connecting section 120 of a rigid frame structure 130. A conventional blade coupling mechanism (not shown) of the skid steer allows said removable attaching ability of the apparatus. The rigid frame structure also includes a mounting section 140 connected to and arranged with the connecting section 120, upon which the major drive elements are mounted. A skid shoe assembly 309 and outrigger pair 420 provide that the apparatus sit evenly on a flat surface when detached from the skid steer, and is easily reattached. This feature renders the apparatus easily transportable for use to any place a skid steer may be transported for use. The reader should note that in order to provide for various arrangements for balancing the apparatus when in a state of detachment from the skid steer, the outriggers are preferably retractable.

Apparatus 100 also includes an engine 150 fixedly mounted on an upper surface of the mounting section 140. The engine is mechanically coupled to a power take off (PTO) 155 to generate and transfer torque. The torque is passed through a drive section 215 to drive a circular cutting blade 170 within a cutting assembly 160 (to be discussed in greater detail below), the circular cutting blade also mounted on the upper surface of mounting section 140. Circular cutting blade 170 is driven to rotate by the drive section 215 in a rotational direction which is counter clockwise to the direction of cutting by forward movement.

Another key feature of applicant's invention is that by utilizing an engine 150 solely for driving the cutting blade 170, in contrast with the arrangement whereby conventional self-propelled road cutting apparatus must share engine power with the driving and cutting tasks, all of the engine's available power may be utilized at the cutting blade for a fast and efficient cut. That is, under arduous road conditions, no power is diverted from the power generated by the engine for propelling the cutting apparatus forward.

Drive section 215 includes a driven shaft 200 connected to an undersurface of mounting section 140 by one or more bearing blocks 205. The driven shaft includes first (210) and second ends (220), where the first end connects to a following pulley 230 and the second end 220 connects to a blade coupling or retainer blade 240 for attachment to circular cutting blade 170. The following pulley is connected to the driving pulley 225 of the power take off via a belt 250. Torque is transferred from the engine 150 and power take off (PTO) 155 through driving pulley 225, belt drive 250 and following pulley 230. Following pulley 230 causes the driven shaft and retainer or coupling blade 240 to rotate the blade 170 when the engine and PTO are engaged The cutting assembly 160 and drive mechanism 200 are arranged such that the circular cutting blade rotates counterclockwise relative a forward cutting direction when the drive mechanism is engaged and powered by the engine.

The cutting blade 170 is disposed within a cutting assembly 160, which includes blade cowling 175 and a cooling system 180. The cooling system 180 includes a fluid pump 185, spray nozzles 190 (not shown in FIG. 1) and spray nozzle conduits 195 for providing a fluid flow path from the pump 185 to the nozzles. The cooling system 180 is preferable connected to a cooling fluid reservoir 260 (not shown in the Figure) via a second conduit 265 to pump 185, mounted somewhere on the front end loading machine. Cowling 175 is included to maintain protection for those working around rotating blade 170, and to house a number of cooling jet nozzles 190 for spraying a coolant, e.g., water, on the blade during a cutting operation. The cowling includes a fixed portion 176 connected to the mounting section 140, and a free portion 178 which may be displaced about hinge 177 for easy access to the blade and/or nozzles.

Connecting section 120 may be constructed with machine plate and include optional heavy metal springs for a spring loaded connection to the front end loading machine.

Figure 2:
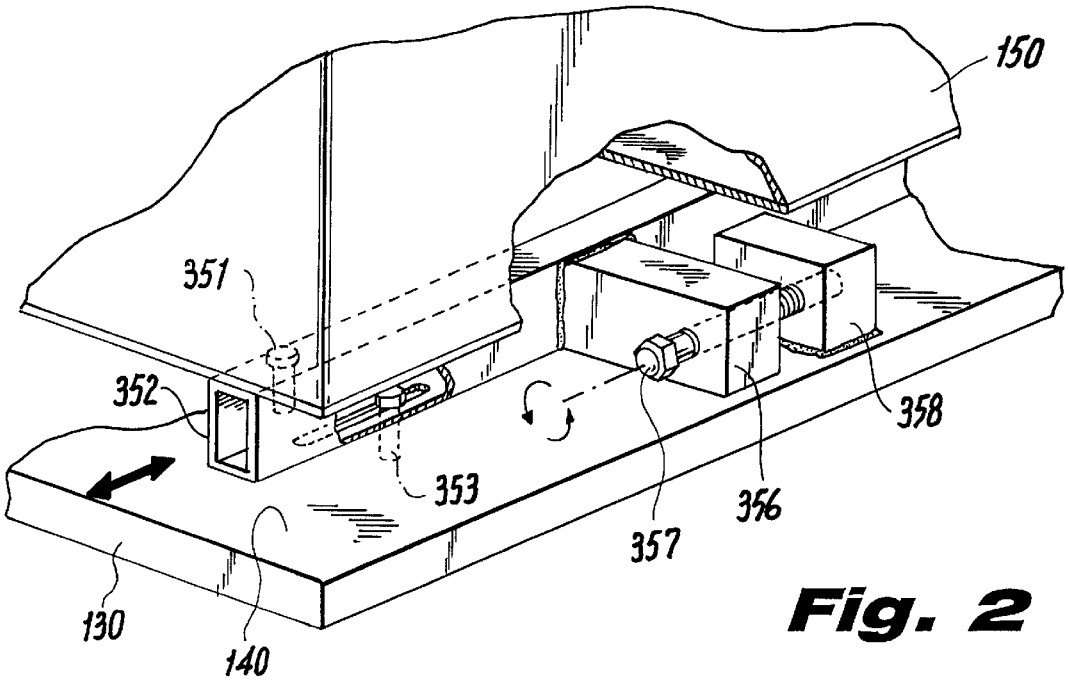
FIG. 2 is a enlarged view of the engine mounted upon the sliding rails.

Engine 150 is mounted by at least one bolt 351 upon a top surface of each of a pair of adjusting rails, 352 and 354. The rails are each slidingly fastened at a bottom surface by at least one bolt 353 to the mounting section 140 and are preferably constructed of u-shape channel steel as is clear from the drawing figures. By loosening the bolts 353, the engine may be moved relative the mounting section. An adjustment mechanism is provided for making adjustments to maintain alignment. A first block 356 is fixed to one of the rails, rail 352 as shown in FIG. 2. A second block 358 is physically attached to the mounting section (e.g., by welding) at a position where it faces the first block. A bolt 357 is arranged to extend through first block 356 to abut against the second block. By turning and advancing the bolt a particular distance relative the first block, the rail and engine move the same distance.

Engine 150 includes an electrical power port 350, an electrical controls port 340, and a fuel port 290 to which a detachable fuel line 285 is connected to a fuel supply 295, preferably disposed on the front end loader. The fuel line connector, the controls cable 338 and power cable 351 each preferably "quick disconnect" connector at each connecting end to provide for an ability to easily and quickly attach/detach for fast start up and shut down when working with the apparatus 100. A control panel 330 is preferable utilized and disposed in front end loader to provide the skid steer operator the ability to observe and control operating conditions. The control panel detachable connects to cable 338, and to the engine, e.g., male-female connector assembly 335, 340.

One of the key benefits realized by the cutting apparatus of this invention is in the ability for the circular cutting blade 170 to be driven counterclockwise relative to a forward direction of cut. Such an arrangement avoids the natural tendency of blades spinning clockwise with the direction of the cut to "climb" out of the cut when the blade encounters material which provides a larger frictional or stopping force upon the rotating blade. In such case, a blade rotating clockwise to the cutting direction tends to be forced upward out of the cut. In contrast, a cutting blade rotating counter clockwise relative a forward cutting direction, as is the case in the present direction, is forced downward into the cut, limited in its cut depth only by the fixed length of the stanchion and ski.

Figure 3:
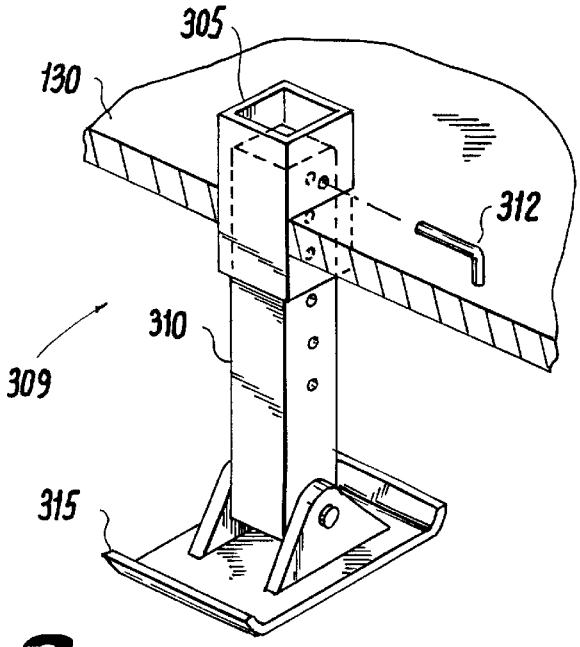
FIG. 3 is an enlarged view of skid shoe assembly of this invention.

FIG. 3 shows this arrangement in more detail.

To determine and maintain the depth of a cut, an adjustable skid shoe assembly 300 is incorporated in the rigid frame structure 130. The adjustable skid shoe assembly includes a box frame 305 which is fixedly mounted to the mounting section of the rigid frame structure. A solid frame or stanchion 310 is arranged to reside within the box frame 305, and fixed thereto by a locking mechanism to define a length of the stanchion which passes through the mounting section and extends down to the cutting surface.

The locking mechanism comprises a set of alignment through holes in the box frame which are aligned with any one of a plurality of sets of alignment through holes vertically spaced along the length of the stanchion through which a locking pin 312 is inserted and fixed. A floating ski or skid shoe 315 is attached to a bottom end of the stanchion 310 in order that the ski make actual contact with the cutting surface during cutting operation. Depending on the length of the stanchion as locked within the box frame, the depth of to which the blade will cut into the cutting surface when operational is limited, i.e., adjusted. To balance the apparatus weight while detached from the front end loading machine, one or more outriggers 420F and 420B are provided under the mounting section 140, preferably the bottom surface thereon.

While the self-propelled front end loading machine is defined herein as a skid steer (110), the definition is meant for exemplary purposes only. The invention is not is limited to use with a skid steer, but may be used by with any front end loader capable of supporting its weight. And as mentioned above, the preferred diesel engine is a 41 HP diesel engine, soured by Deutsch Corp., Germany, the diamond blades provided by Felker, Inc., Pennsylvania and the PTO provided by Twin Disc, Racine Wisconsin. The pump is provided by Shurflo, Santa Anna, Calif. While the size of the cutting blade may vary in diameter from 18 to 42 inches (depending on the needs of the job), and from ⅛" to ⅜" in width, the preferred cutting blade is a 36 inch diameter diamond blade with an ⅛" width. Preferably, the belt is a 10 channel serpentine belt, and the preferred cutting blade having a 36 inch diameter.

Figure 4:
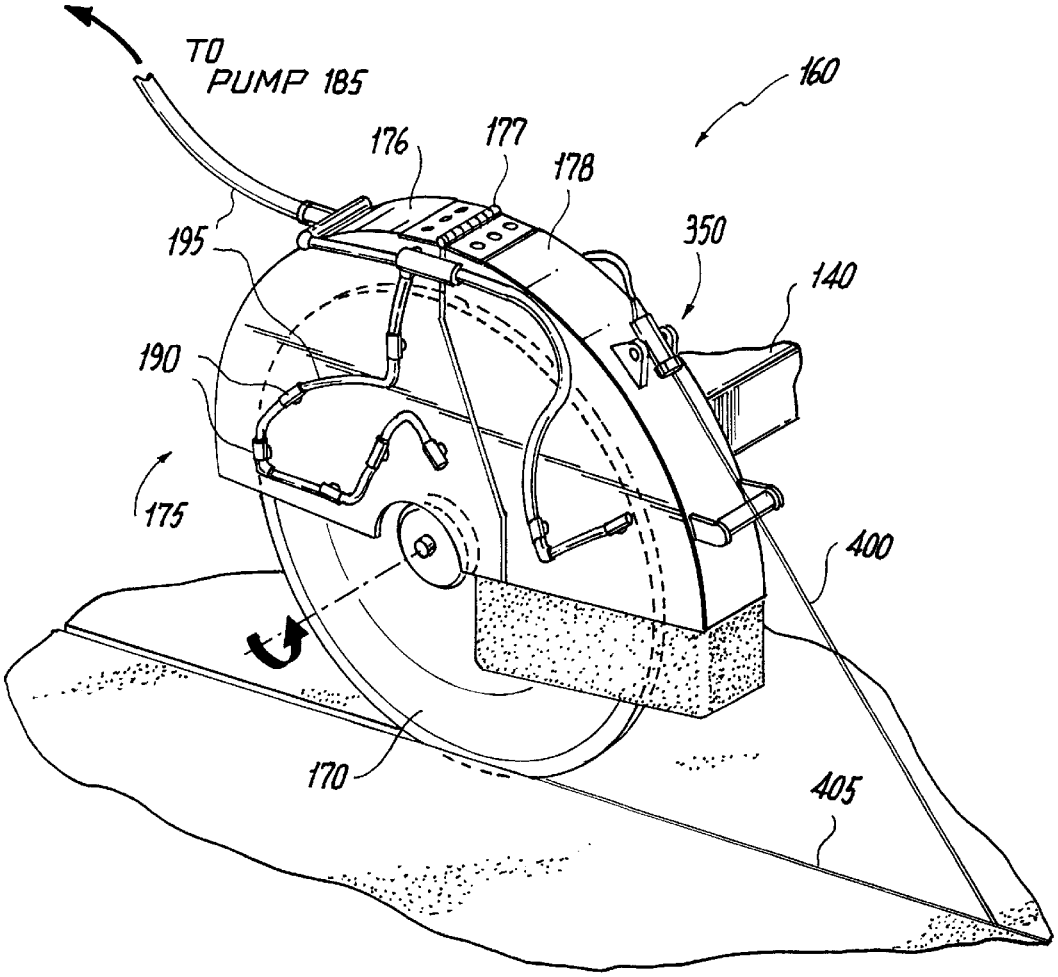
FIG. 4 is an enlarged view of a cutting assembly of the invention with laser cut adjusting apparatus.

A laser device 350 is preferably attached to the cowling 175 such that it focuses a light beam on a spot in the near road surface to be cut whereby an operator can maintain an exact and linear cut by maintaining the laser light in a painted or chalk guide provided at the cutting surface. FIG. 4 shows a side view of the cowling 175 blade with laser 350 mounted. The laser is shown shining its beam 400 upon a chalk mark 405 shown in the FIG. 4. An operator can align his forward moving movement by the beam' 400 alignment ion the chalk line 405. Very accurate cuts, both in the cut and with the cut are possible with the invention, at very high speeds is provided by the apparatus herein.

What is claimed is:

1. A road cutting apparatus detachable and connectable to a self-propelled front end loading machine, comprising:

rigid frame structure comprising (1) a connecting section for attaching the frame structure to the front end loading machine and (2) a planar mounting section, wherein a plane of the connecting section is set substantially perpendicularly to a plane of the planar mounting section;

an engine including a power take off (PTO) mounted to a top surface of the mounting section for driving a circular cutting blade;

a belt drive attached to the PTO including a driving pulley, a following pulley and a belt disposed between the driving pulley and following pulley for a transfer of torque therebetween;

a driven shaft with a first end and a second end mounted to a bottom surface of said mounting section, wherein the first end of the shaft is attached to the following pulley and the second end of the shaft is attached a retainer blade for coupling the driven shaft to the circular cutting blade; and a cutting blade assembly mounted on the mounting section comprising said circular cutting blade and a cooling system for providing a flow of cooling fluid to said circular cutting blade, wherein said circular cutting blade rotates counterclockwise relative a forward cutting direction of said front end loader when said PTO is engaged and powered by said engine.

2. The road cutting apparatus defined by claim 1, wherein the connecting section is constructed to attach to a blade coupling mechanism of the front end loading machine.

3. The road cutting apparatus defined by claim 1, wherein the connecting section of the rigid frame structure comprises machine plate.

4. The road cutting apparatus defined by claim 1, wherein said cutting blade has a 36" diameter.

5. The road cutting apparatus defined by claim 1, wherein said engine is powered by one of gas, diesel and electric power.

6. The road cutting apparatus defined by claim 1, wherein said belt is a serpentine design with at least 2 grooves to complement a structure of said driving and following pulleys.

7. The road cutting apparatus defined by claim 1, wherein said cutting apparatus includes a cowling extending around a portion of a perimeter of said circular cutting blade at its position in the cutting apparatus.

8. The road cutting apparatus defined by claim 7, wherein said cowling includes fixed portion, a free portion and a hinge, and wherein the free portion may be displaced away from said blade about said hinge for maintenance procedures.

9. The road cutting apparatus defined by claim 7, wherein said cooling system comprises at least one spray nozzle mounted at an inner surface of said cowling.

10. The road cutting apparatus of claim 7, further comprising a laser device mounted on said cowling for shining a light beam on a road surface to maintain cut alignment during cutting operation.

11. The road cutting apparatus defined by claim 1, further comprising a quick disconnect for detachable coupling an electrical supply to said engine.

12. The road cutting apparatus of claim 1, further comprising a control panel mountable in said front end loading machine and connectable to said apparatus via quick disconnect means.

13. The road cutting apparatus of claim 1, wherein said frame structure comprises u-shaped channel steel.

14. The road cutting apparatus of claim 1, further including first and second slide mounting rails attached to said mounting section, wherein said engine is mounted upon said slide mounting rails.

15. The road cutting apparatus of claim 14, wherein said engine may be adjusted on said slide mounting rails to increase and decrease a distance from a center of said driving pulley to a center of said following pulley to accommodate changes in belt characteristics.

16. The road cutting apparatus defined by claim 1, further comprising a skid shoe assembly arranged on the mounting section proximate the cutting assembly for providing and maintaining an adjustable cut depth.

17. The road cutting apparatus of claim 16, wherein the skid shoe assembly comprises a box frame attached to said mounting section, a stanchion for insertion into said box frame, the stanchion including a floating type ski.

18. The road cutting apparatus of claim 17, wherein said box frame includes a throughhole and said stanchion includes a plurality of depth alignment holes, whereby a locking pin may be inserted through said box frame and stanchion to define an exact distance between the road surface and said mounting section to control cut depth.

19. The road cutting apparatus of claim 18, further including at least one outrigger attached to said mounting section which can be extended to maintain said apparatus in a balanced position when detached from said front end loading machine.

20. The road cutting apparatus of claim 19, wherein said at least one outrigger is retractable.

* * * * *